US005777281A

United States Patent [19]

Riddiford

[11] Patent Number: 5,777,281

[45] Date of Patent: Jul. 7, 1998

[54] KEY ASSEMBLY

[75] Inventor: Martin Philip Riddiford, London, United Kingdom

[73] Assignee: Psion Computers PLC, London, United Kingdom

[21] Appl. No.: 723,881

[22] Filed: Sep. 23, 1996

[30] Foreign Application Priority Data

Sep. 26, 1995 [GB] United Kingdom ..... 9519557

[51] Int. Cl.[6] ..... H01H 13/70

[52] U.S. Cl. ..... 200/5 A; 200/517

[58] Field of Search ..... 200/5 R, 5 A, 200/511–517, 520, 341, 342, 344, 345; 400/490, 42, 491.1, 491.2, 495, 495.1; 235/145 R, 146

[56] References Cited

U.S. PATENT DOCUMENTS

| | | | |
|---|---|---|---|
| 3,721,778 | 3/1973 | Seeger, Jr. et al. | 200/5 R |
| 5,034,573 | 7/1991 | Bonmassari et al. | 200/5 A |
| 5,115,106 | 5/1992 | Weiland et al. | 200/517 |
| 5,256,843 | 10/1993 | Chiba et al. | 200/517 |
| 5,298,706 | 3/1994 | English et al. | 200/517 |
| 5,310,973 | 5/1994 | Lee | 200/345 |
| 5,438,177 | 8/1995 | Fagan | 200/517 |
| 5,525,979 | 6/1996 | Engle et al. | 341/32 |

*Primary Examiner*—Michael L. Gellner
*Assistant Examiner*—Michael A. Friedhofer
*Attorney, Agent, or Firm*—Sughrue, Mion, Zinn, Macpeak & Seas, PLLC

[57] ABSTRACT

A key assembly comprising a base; a manually operable key secured to, and mounted above the base by, a resilient key mat having an upstanding wall. The key is moveable against the resilience of the upstanding wall towards the base. A guide assembly extends between the base and the key to guide movement of the keys. A membrane is supported on the base and carries a pair of electrically insulated first contacts, each first contact of the pair being connected to a respective electrical track supported on the membrane and extending to a connection location. A second contact is provided on the underside of the key or the key mat and has a size and position such that movement of the key towards the base causes the second contact to engage both first contacts and thereby electrically connect the first contacts.

20 Claims, 5 Drawing Sheets

KEY ASSEMBLY

FIELD OF THE INVENTION

The invention relates to a key assembly, for example for use in a key pad for computing equipment.

DESCRIPTION OF THE PRIOR ART

With the development of small scale computing equipment, it is necessary to devise key assemblies which are compatible and have small height dimensions. On the other hand, users prefer keys which have significant travel distance firstly to avoid light pressure inadvertently actuating the switch and secondly to enable the switch to provide a tactile response. Conventional computer keyboards which have not been restricted by height requirements can have heights up to 15 mm and key travel distances of 2 or 3 mm. However, these are not suitable for smaller scale computing equipment such as notebook computers, for example the Psion Series 3a. In this case, a key pad is used with an overall height of about 4 mm but with the significant drawback that the key travel distance is only 0.7 mm. This key assembly provides the key in a floating arrangement above a base, supported by a resilient rubber mat. A further drawback of this arrangement is that the key can rock from side to side and cannot be accurately activated.

Another example of a known membrane switch is described in U.S. Pat. No. 5,438,177. In this switch, the key is guided in a key assembly but still takes up a significant vertical dimension.

SUMMARY OF THE INVENTION

In accordance with the present invention, a key assembly comprises a base; a manually operable key secured to, and mounted above the base by, a resilient key mat having an upstanding wall, the key being moveable against the resilience of the upstanding wall towards the base; a guide assembly extending between the base and the key to guide movement of the key; a membrane supported on the base and carrying a pair of electrically insulated first contacts, each first contact of the pair being connected to a respective electrical track supported on the membrane and extending to a connection location; and a second contact provided on the underside of the key or the key mat and having a size and position such that movement of the key towards the base causes the second contact to engage both first contacts and thereby electrically connect the first contacts.

We have devised a new key assembly which enables the above problems to be overcome but in which the resultant assembly has a height dimension which is still compatible with small, notebook or palmtop style computer equipment. This is achieved by providing the contacts and all tracks on a common membrane in contrast with U.S. Pat. No. 5,438,177 where separate membranes have to be used. In some cases the tracks are provided only on one side of the membrane but conveniently they are provided on both sides thus allowing more tracks to be accommodated.

The invention enables key assemblies having heights of the order of 6 mm to be manufactured but in which the key travel distance is up to 1.2 mm. This results in a much more acceptable key assembly which can be incorporated into notebook or palmtop style computers.

The upstanding wall could have a cylindrical form but preferably is frusto-conical tapering inwardly from the base towards the key.

Since two first contacts are provided defining a pair of switch contacts, the second contact acts as a switch member and selectively connects the first contacts with the advantage that an electrical circuit only needs to be connected to the first contacts and so no track connections to the second contact are required.

The first contacts may be spaced about an arc, the second contact extending along the arc and, for example, the second contact could form a closed curve such as a circle.

The membrane may be fully supported on the base but in the preferred arrangement, the part of the membrane carrying the first contacts overlies a recess in the base whereby movement of the key towards the base causes the membrane to be pushed against its resilience into the recess. This allows a certain amount of overtravel of the key to be permitted increasing the tactile response in a desirable manner. Typically, the recess will extend around the guide assembly and have a depth of substantially 0.15 mm.

The upstanding wall of the resilient key mat is preferably continuous but instead could be defined by a set of circumferentially spaced legs. The advantage of a continuous wall is that the wall presents a substantially symmetrical resilience to the key.

The key itself could be mounted to the key mat in a variety of ways but conveniently the resilient key mat has an upper, cylindrical section integrally formed with the upstanding wall and fitted to a depending neck on the underside of the key. Typically, the neck of the key will be inserted into the cylindrical section of the key mat. The reverse arrangement is also possible.

Preferably, the guide assembly comprises a cooperating finger and socket, one on the base and the other on the key. Conveniently, the finger is mounted on the underside of the key and the socket is provided in the base. This arrangement is more easily manufactured than the reverse arrangement.

The connection between the key and the resilient key mat will provide a certain securement of the key in place but preferably one of the finger and socket has a laterally extending lug and the other a resilient tab such that, on insertion of the finger into the socket, the lug snaps over the tab to retain the key on the guide assembly.

The finger could have a circular cross-section but in order to reduce twisting movement of the key it is preferred that the finger and socket each have an interlocking form, for example a hexagonal or a cruciform cross-section.

As mentioned above, the key assembly according to the invention can be incorporated into a key pad having a number of such key assemblies and in this case, preferably the first electrical contacts of each of the keys are provided on a common membrane or printed circuit board, and preferably also the resilient key mats of each key are formed from a common resilient key mat. These preferred features assist in reducing manufacturing complexities and hence cost.

The key pad can be used in any conventional application of a key pad but is particularly suited for applications where the height of the keypad is critical as mentioned earlier. When the keypad is used with computing equipment, the computing equipment will include a processor connected to the first contact via the tracks so as to enable the location of a depressed key to be determined. This can be achieved in any conventional manner using conventional array scanning techniques which will be well known to persons of ordinary skill in the art.

BRIEF DESCRIPTION OF THE DRAWINGS

An example of a key pad having key assemblies according to the invention will now be described with reference to the accompanying drawings, in which.

DETAILED DESCRIPTION OF THE EMBODIMENT

Figure 1:
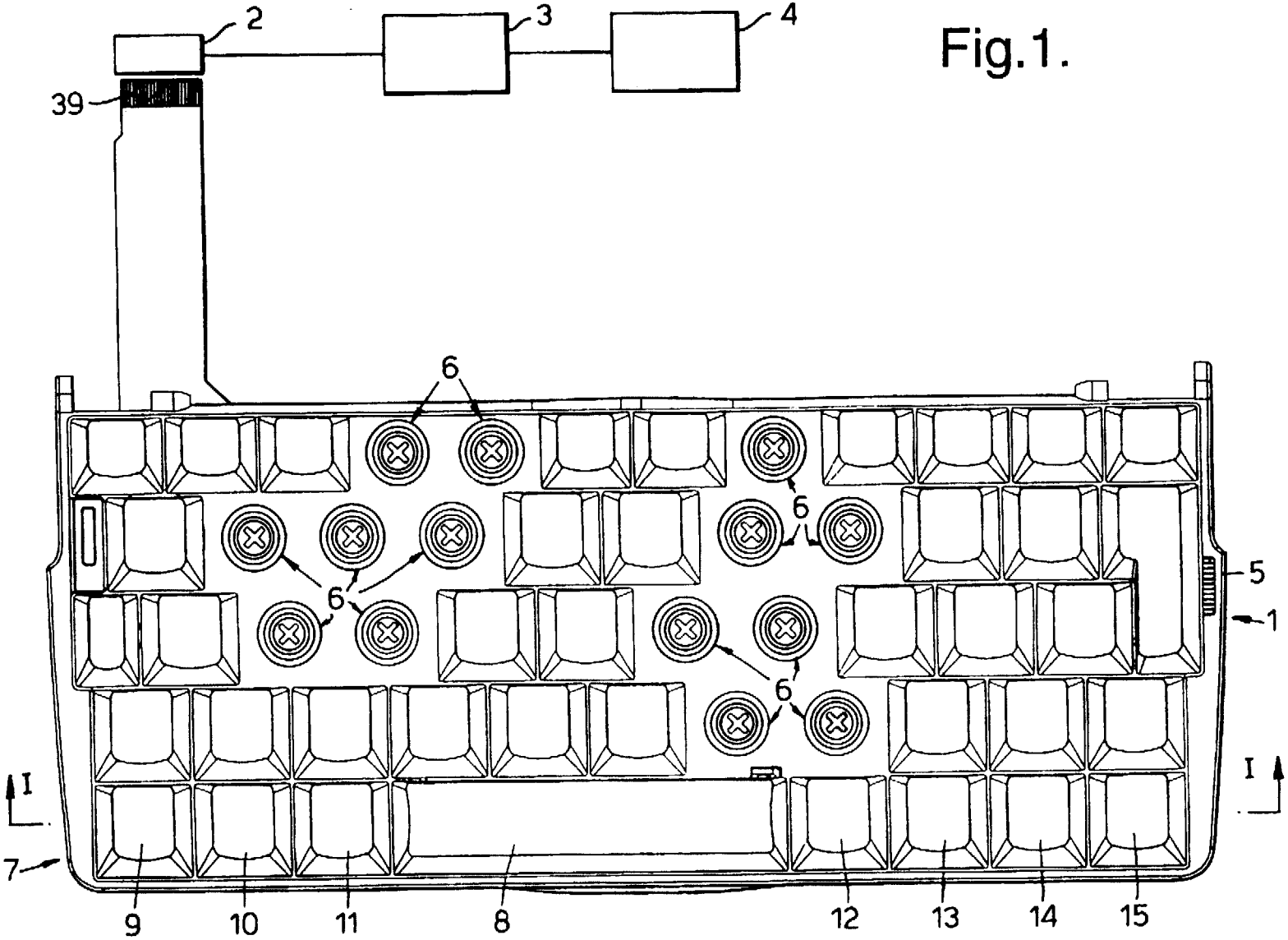
FIG. 1 is a plan of the key pad connected to computing equipment, with some keys omitted.

FIG. 1 illustrates a keypad 1 connected via a socket 2 to a processor 3 which in turn is connected to a display 4. The keypad includes a plastics base 5 which will typically form part of computing equipment in which the processor 3 and socket 2 are also housed. For clarity, the other parts of the computing equipment have been omitted.

Typically, the elements shown in FIG. 1 will be housed within a notebook computer with the screen or display 4 hinged to the base of the keypad 5. Typical dimensions for such equipment when closed are 170 mm×90 mm×20 mm.

As can be seen in FIG. 1, the keypad 1 has a conventional arrangement of plastics keys arranged in five parallel rows. Certain keys have been omitted to enable the mounting arrangements 6 to be seen.

Figure 2:
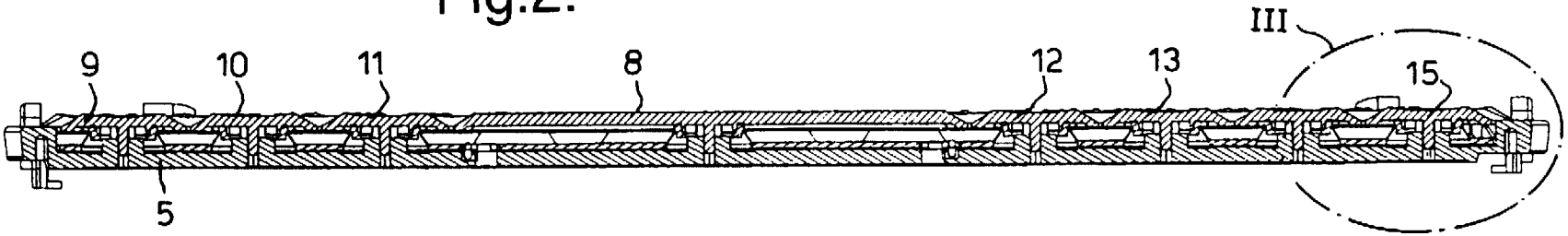
FIG. 2 is a section taken along the line A—A in FIG. 1.

FIG. 2 illustrates in cross-section the row of keys 7. The row comprises a "space "key 8 flanked on either side by keys 9–11 and 12–15 respectively.

Figure 5:
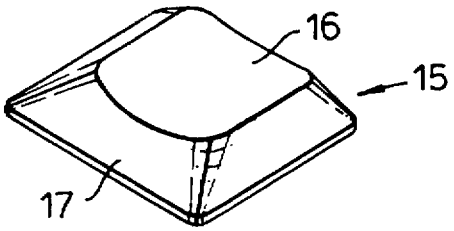
FIG. 5 is a perspective view from above of a key.
Figure 6:
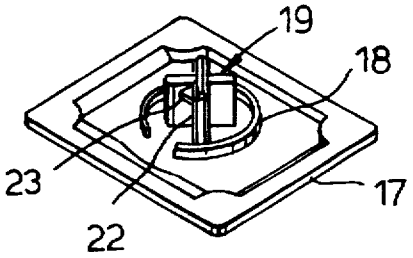
FIG. 6 is a perspective view from below of the key shown in FIG. 5.

The key 15 is shown in more detail in FIGS. 5 and 6. As can be seen, the key has a scalloped upper member 16 onto which the user's finger is placed in use and a four sided, outwardly tapering depending skirt 17 integrally formed with the member 16.

The underside of the key 15 (FIG. 6) includes a circular depending neck 18 secured to the underside of the member 16 together with a depending finger 19 having a cruciform shape, the finger 19 being mounted centrally with respect to the key.

Figure 3:
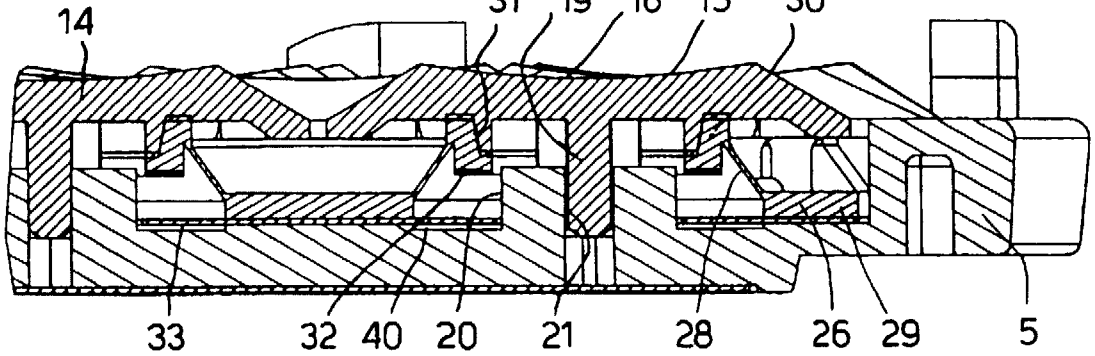
FIG. 3 is an enlarged view of detail B in FIG. 2.

The mounting arrangement of the key 15 is shown in more detail in the enlarged, partial cross-section of FIG. 3.

Figure 7:
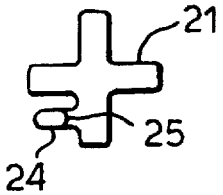
FIG. 7 is a cross-section through the bore shown in FIG. 3.

As can be seen in FIG. 3, the base 5 has an integrally formed boss 20 in which a bore 21 is formed. The bore 21 is shown in more detail in FIG. 7 and as can be seen has a cruciform shape corresponding to the shape of the finger 19. The finger 19 is located in the bore 21 and because of the matching cruciform shapes, cannot rotate relative to the bore 21. In order to retain the key 15 on the base 5, one of the legs 22 of the finger 19 is formed with a laterally extending lug 23 which fits into a corresponding slot 24 of the bore 21. At the upper end of the slot 24 is positioned a resilient tab 25 which will flex, on insertion of the finger 19 into the bore 21, when it engages with the lug 23 and then snap back behind the lug 23 so that the finger 19 is retained in the bore 21.

Figure 4:
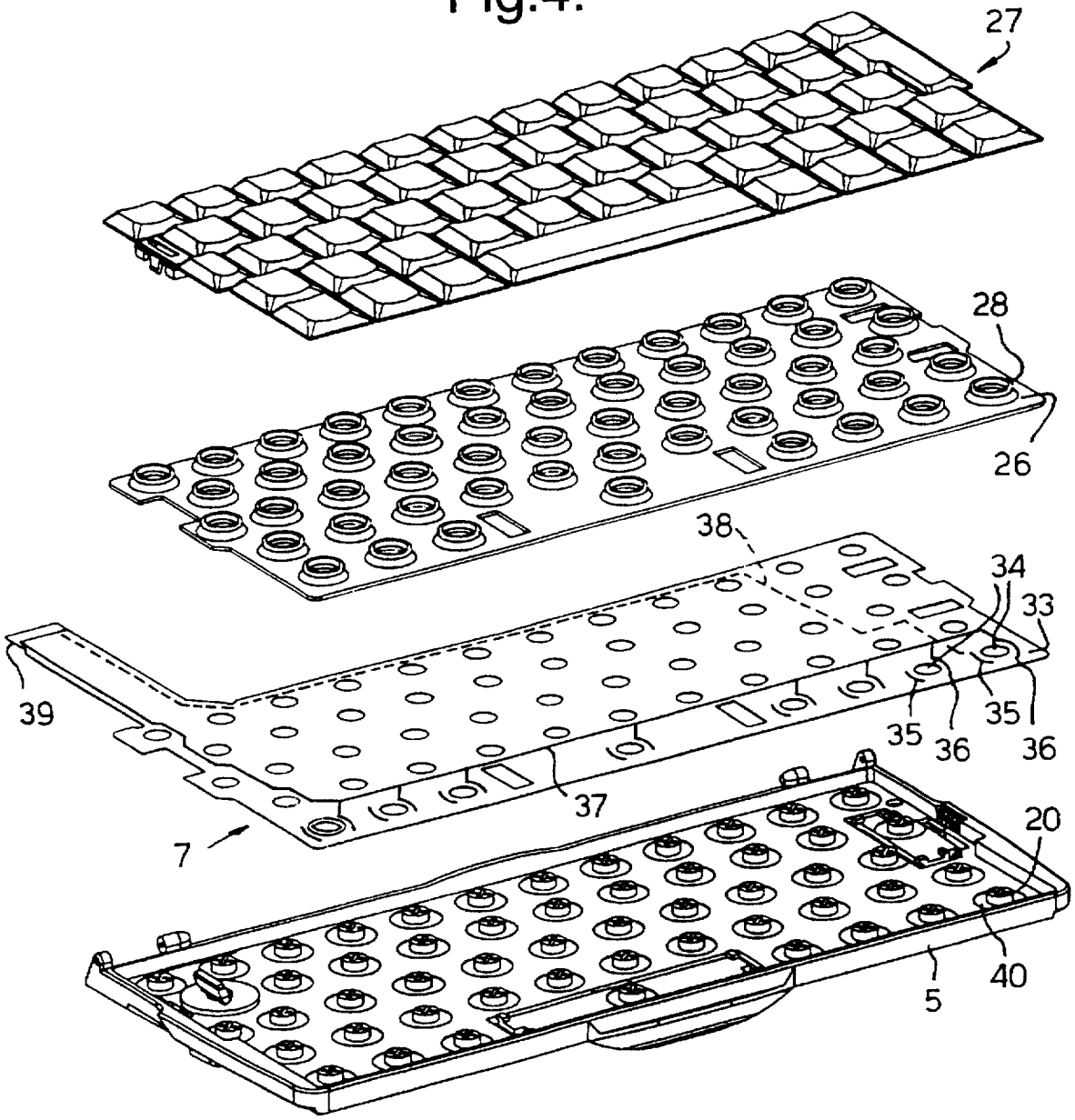
FIG. 4 is an exploded view of the key pad shown in FIG. 1.
Figure 8:
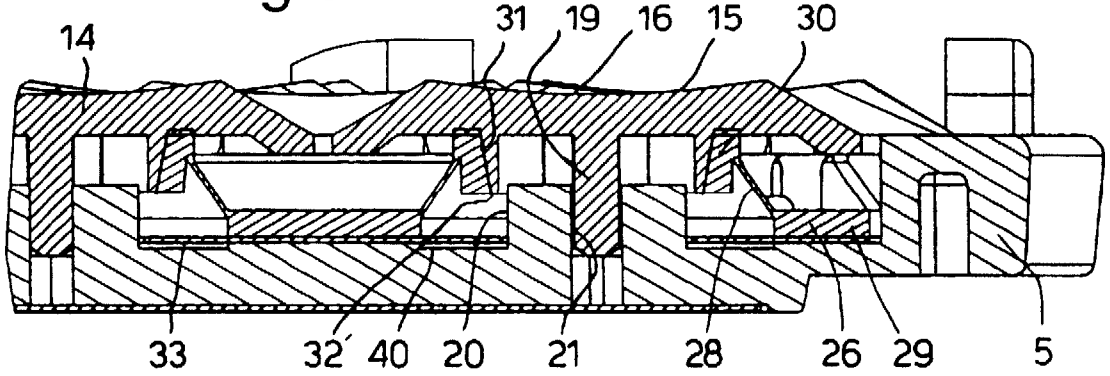
FIG. 8 is a view showing an alternative embodiment of the invention.

The key 15 is supported above the base 5 by a resilient rubber mat 26 shown in more detail in FIG. 4. For each key in the keypad, as shown at 27 in FIG. 4, the mat 26 has an upstanding, frusto-conical portion 28 extending between a base portion 29 and an integrally formed circular portion 30. The circular portion 30 has an inner surface 31 shaped to conform with the outer surface of the neck 18 of the key 15 onto which it is push fitted. The frusto-conical portion 28 has sufficient resilience to hold the key 15 in the position shown in FIG. 3 above the base 5. The circular portion 30 supports on its under surface a circular, metal contact 32. Alternatively, as shown in FIG. 8, the contact 32 may be mounted on the underside of key 15.

A printed circuit board 33 defines a membrane having a set of apertures 34 through which respective bosses of the base 5 extend. Extending partially about opposed sides of the apertures 34 are a pair of electrical contacts 35, 36 formed as arcs. For clarity, only the contacts 35,36 corresponding to the row 7 are shown. Each of the contacts 36 in the row 7 is electrically connected to a common track 37 provided on the upper surface of the membrane 33 and extending to a ribbon plug connector 39. It will be understood that the corresponding contacts in other rows will be connected to respective common tracks (not shown), each track extending to the connector 39 along the upper surface of the pcb 33.

The contact 35 associated with the key 15 is connected to a track 38 provided on the underside of the membrane 33. Connection to the track 38 is achieved via a connector extending through a bore (not shown) in the membrane 33. The track 38 extends beneath the membrane 33 to the opposite side of the ribbon connector 39. Once again, it will be noted that the other contacts 35 will be connected to respective tracks (not shown) on the underside of the membrane 33.

In order to increase the tactile response of the keypad, a circular recess 40 having a depth of 0.15 mm extends around each boss 20. It will be seen in FIG. 3 that part of the membrane 33 extends over the recess 40 and this part is directly beneath the contact 32 and carries the contacts 35,36 (not shown in FIG. 3).

When the key 15 is depressed, the frusto-conical section 28 of the rubber mat 26 will flex allowing the key 15 to be pushed downwardly towards the membrane 33. After travelling about 1.05 mm, the contact 32 engages the contacts 35,36 thus electrically connecting the contacts 35,36 together. As the key is pushed further, it will be pushed against the inherent resilience of the membrane 33, part of the membrane 33 being pushed into the recess 40.

When the key 15 is released, the resilience of the frusto-conical section 28 will push the key 15 back up to the position shown in FIG. 3. The frusto-conical section 28 also provides a tactile feel during downward movement of the key 15.

In use, the processor 3 is connected via the socket 2 and ribbon connector 39 to the tracks 37,38 and polls the tracks in a regular manner to detect the electrical connection between any pair of contacts 35,36 due to depression of a corresponding key. This information is then used by the processor in any conventional manner, for example to display an alpha-numeric character corresponding to the key on the display 4.

I claim:

1. A key assembly comprising a base; a manually operable key secured to, and mounted above said base by, a resilient key mat having an upstanding wall, the key having a depending neck and being moveable against the resilience of said upstanding wall towards said base; a guide assembly extending between said base and said key to guide movement of said key; a membrane supported on said base and carrying a pair of electrically insulated first contacts, each of said first contacts of the pair being connected to a respective electrical track supported on said membrane and extending to a connection location; and a second contact provided on an underside of one of said depending neck and a portion of said key mat in contact with said depending neck and having a size and position such that movement of said key towards said base causes said second contact to engage both of said first contacts and thereby electrically connect said first contacts.

2. An assembly according to claim 1, wherein said first contacts are spaced about an arc, said second contact extending along said arc.

3. An assembly according to claim 2, wherein said second contact forms a closed curve.

4. An assembly according to claim 3, wherein said closed curve is a circle.

5. An assembly according to claim 2, wherein said first contacts are positioned about said guide assembly.

6. An assembly according to claim 1, wherein said tracks are provided on both sides of said membrane.

7. An assembly according to claim 1, wherein said resilient key mat has an upper, cylindrical section integrally formed with said upstanding wall and fitted to said depending neck, said depending neck being positioned on an underside of said key.

8. An assembly according to claim 1, wherein a part of said membrane carrying said first contacts overlies a recess in said base whereby movement of the key towards the base causes the membrane to be pushed against said resilient key mat into the recess.

9. An assembly according to claim 8, wherein said recess extends around said guide assembly.

10. An assembly according to claim 1, wherein said guide assembly comprises a cooperating finger and socket, one on said base and the other on said key.

11. An assembly according to claim 10, wherein said finger is mounted on an underside of said key and said socket is provided in said base.

12. An assembly according to claim 10, wherein said finger and socket each have a cruciform cross-section.

13. An assembly according to claim 10, wherein one of said finger and said socket has a laterally extending lug and the other a resilient tab such that, on insertion of said finger into said socket, said lug snaps over said tab to retain the key on said guide assembly.

14. An assembly according to claim 1, wherein said second contact is provided on an underside of said depending neck.

15. A key pad having a plurality of key assemblies, each key assembly comprising a base; a manually operable key secured to, and mounted above said base by, a resilient key mat having an upstanding wall, the key having a depending neck and being moveable against the resilience of said upstanding wall towards said base; a guide assembly extending between said base and said key to guide movement of said key; a membrane supported on said base and carrying a pair of electrically insulated first contacts, each of said first contacts of the pair being connected to a respective electrical track supported on said membrane and extending to a connection location; and a second contact provided on an underside of one of said depending neck and a portion of said key mat in contact with said depending neck and having a size and position such that movement of said key towards said base causes said second contact to engage both of said first contacts and thereby electrically connected said first contacts.

16. A key pad according to claim 15, wherein said first contacts of each of said keys are provided on a common membrane.

17. A key pad according to claim 15, wherein said resilient key mats of each key are formed from a common resilient key mat.

18. A key pad according to claim 15, wherein said second contact is provided on an underside of said depending neck.

19. Computing equipment including a processor and a key pad, the key pad having a plurality of key assemblies, each key assembly comprising a base; a manually operable key secured to, and mounted above said base by, a resilient key mat having an upstanding wall, the key having a depending neck and being moveable against the resilience of said upstanding wall towards said base; a guide assembly extending between said base and said key to guide movement of said key; a membrane supported on said base and carrying a pair of electrically insulated first contacts, each of said first contacts of the pair being connected to a respective electrical track supported on said membrane and extending to a connection location; and a second contact provided on an underside of one of said depending neck and a portion of said key mat in contact with said depending neck and having a size and position such that movement of said key towards said base causes said second contact to engage both of said first contacts and thereby electrically connect said first contacts, said key pad being coupled via the tracks to said processor.

20. Computing equipment according to claim 19, wherein said second contact is provided on an underside of said depending neck.

* * * * *